United States Patent [19]

Howarth

[11] 4,324,365

[45] Apr. 13, 1982

[54] NEBULIZER

[75] Inventor: Harry Howarth, Mount Waverley, Australia

[73] Assignee: Varian Techtron Pty. Ltd., Victoria, Australia

[21] Appl. No.: 89,819

[22] Filed: Oct. 31, 1979

[30] Foreign Application Priority Data

Nov. 6, 1978 [AU] Australia ..... PD6655

[51] Int. Cl.[3] ..... B05B 7/06

[52] U.S. Cl. ..... 239/424; 239/433; 239/600

[58] Field of Search ..... 239/424, 424.5, 429, 239/430, 433, 600

[56] References Cited

U.S. PATENT DOCUMENTS 2,379,161 6/1945 Kraps ..... 239/424 X 3,430,864 3/1969 Miller et al. ..... 239/424

*Primary Examiner*—Andres Kashnikow

*Attorney, Agent, or Firm*—Stanley Z. Cole; Keiichi Nishimura

[57] ABSTRACT

A nebulizer for use with spectroscopy having a main body member containing, within a guide bore, a venturi body, a liquid feed tube and a sleeve surrounding the tube and having air passages formed therein. The venturi body contains an axial throat which communicates directly with a relatively large chamber—e.g., at least four times the diameter of the throat—and that throat is held coaxial with the guide bore by radial confinement of the venturi body within that bore. The tube extends into the throat towards the chamber and terminates adjacent the outlet end of the throat. The sleeve fits within the guide bore and over the tube to hold the tube concentric with the throat and the outside diameter of the tube is approximately 75% of the throat diameter to provide clearance for passage of air. The air passages in the sleeve communicate with the inlet end of the throat through a space provided between respective frusto-conical end surfaces of the sleeve and venturi body. The sleeve and venturi body are releasably held in position within the guide bore.

7 Claims, 6 Drawing Figures

NEBULIZER

This invention relates to nebulizers, and although such nebulizers may be used in a wide variety of applications it will be convenient to describe the invention with reference to a nebulizer for use in spectroscopy. It is to be understood however, that the invention is not limited to that example application.

Conventional nebulizers as used with spectrophotometers suffer from sensitivity to changes in the relative positioning of components and/or to changes in the configuration of the components due to wear. For example, in one conventional nebulizer of that kind which is shown diagrammatically in the attached FIG. 1, the position of the terminal end of the capillary tube relative to the inlet end of the venturi throat, is critical. In practice, that critical position can be varied by load applied to the capillary tube, and as a consequence there will usually be a substantial reduction in atomization efficiency and rate of liquid uptake. A similar adverse affect may result from erosion of the inlet edge of the venturi throat due to air flow across that edge, or from corrosion of the terminal end of the capillary tube due to the nature of the liquids fed through that tube. In view of the foregoing, it is difficult to maintain a consistent level of performance for a given length of time.

It is a principal object of the present invention to provide a nebulizer which is less sensitive to relative positioning of the nebulizer components and/or to changes of the state of those components. It is a further object of the invention to provide a nebulizer having improved atomization efficiency when compared with prior nebulizers.

According to one aspect of the invention, there is provided a nebulizer including venturi means, a cylindrical throat and a cylindrical chamber each forming part of said venturi means and being arranged in substantially coaxial end to end communication, the diameter of said chamber being at least twice the diameter of said throat, said throat having an inlet end remote from said chamber and an outlet end adjacent said chamber, a liquid feed tube arranged substantially coaxial with said throat, said tube extending from a location remote from said throat inlet end towards said chamber and at least up to a location adjacent said throat inlet end, and air feed passage means external of said tube and communication with said throat inlet end.

According to another aspect of the invention, there is provided a nebulizer including venturi means, a cylindrical throat and a cylindrical chamber each forming part of said venturi means and being arranged in substantially coaxial end to end communication, the diameter of said chamber being larger than the diameter of said throat, said throat having an inlet end remote from said chamber and an outlet end adjacent said chamber, a liquid feed tube having an external diameter less than the diameter of said throat, said tube extending into said throat through said inlet end thereof and terminating at a location remote from said inlet end, and air feed passage means external of said tube and communicating with said throat inlet end.

According to yet another aspect of the invention, there is provided a nebulizer including, venturi means, a cylindrical throat and a cylindrical chamber each forming part of said venturi means and being arranged in substantially coaxial end to end communication, the diameter of said chamber being larger than the diameter of said throat, said throat having an inlet end remote from said chamber and an outlet end adjacent said chamber, a liquid feed tube extending from a location remote from said throat inlet end towards said chamber and at least up to a location adjacent said throat inlet end, a main body member, a guide bore formed within said main body member, a venturi body having said cylindrical throat formed through one end and having a cylindrical outer surface which is concentric with said throat, said cylindrical outer surface is located within said main body member bore and has substantially the same diameter as said bore, a sleeve located within said main body member bore adjacent said one end of the venturi body, said sleeve having an external cylindrical surface and a bore concentric with that surface, said sleeve external cylindrical surface having a diameter substantially equal to the diameter of said main body member bore, said sleeve bore having substantially the same diameter as the external surface of said tube, said tube extending through said sleeve bore to be held thereby against lateral movement, at least one air passage formed in said sleeve and communicating with said throat inlet end, and retainer means holding said sleeve and said venturi body in fixed axial positions within said main body member bore.

According to a still further aspect of the invention, there is provided a nebulizer including a main body member, a guide bore within said main body member, a stop shoulder within said bore and spaced from one end thereof, a venturi body at least partially located within said bore and abutting said stop shoulder, a throat formed through one end of said venturi body and having an inlet end at said one end, a chamber formed in said venturi body and communicating with the outlet end of said throat, a sleeve located within said main body member bore and abutting said one end of the venturi body, a liquid feed tube extending coaxially through said sleeve and being held thereby against radial movement, said tube extending towards said chamber and at least up to a location adjacent said throat inlet end, at least one air passage formed in said sleeve and communicating with said throat inlet end, and retainer means releasably holding said venturi body and said sleeve in end to end abutment within said main body member.

In accordance with another aspect of the invention, there is provided a nebulizer for use in spectroscopy including a main body member having a guide bore therein, a venturi body located within said guide bore adjacent one end thereof and being held against lateral movement by engagement with said guide bore surface, stop means holding said venturi body against axial movement beyond a fixed position towards said one end of the guide bore, a throat extending through the end of said venturi body adjacent the end of said guide bore remote from said one end thereof and having an inlet end at said end of the venturi body, said throat being concentric with said guide bore, a chamber formed in said venturi body in direct axial communication with an outlet end of said throat and being large in cross-sectional size relative to said throat, a liquid feed tube extending into said throat through the inlet end thereof and terminating adjacent said throat outlet end, said tube having an external diameter less than the diameter of said throat to provide an air passage space between the adjacent surfaces of said tube and throat, a sleeve located in said guide bore in engagement with said venturi body end, said tube extending axially through said sleeve and being held thereby at a location adjacent said throat to be concentric with said throat, means holding said tube against axial movement relative to said sleeve, air passage means in said sleeve communicating with said throat inlet end outwardly of said tube, and retainer means releasably holding said sleeve and venturi body against removal from said main body member through said remote end thereof.

It is generally preferred to have the liquid feed tube projecting through a substantial part of the throat length in all aspects of the invention. Nevertheless, it has been found that a nebulizer according to the invention operates with better efficiency than prior constructions even when the tube terminates adjacent the throat inlet end, but it is usually necessary for that purpose to have the diameter of the venturi chamber more than twice the diameter of the throat. Best results are achieved with the chamber diameter at least four times greater than the throat diameter.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

Figure 2:
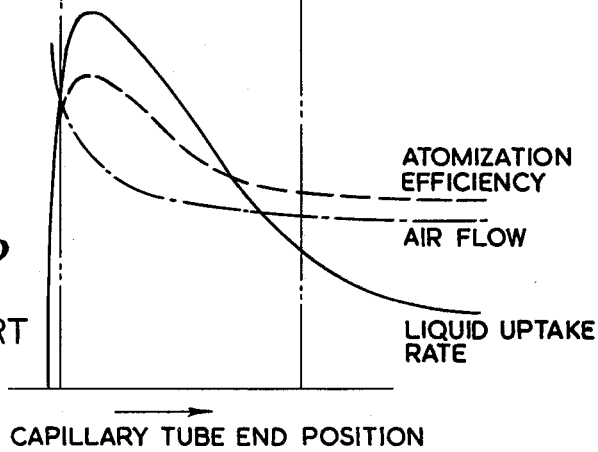
Fig 2 PRIOR ART
FIG. 2 is a graph related to FIG. 1 and which shows the atomization efficiency at various axial positions of the liquid capillary tube.
Figure 3:
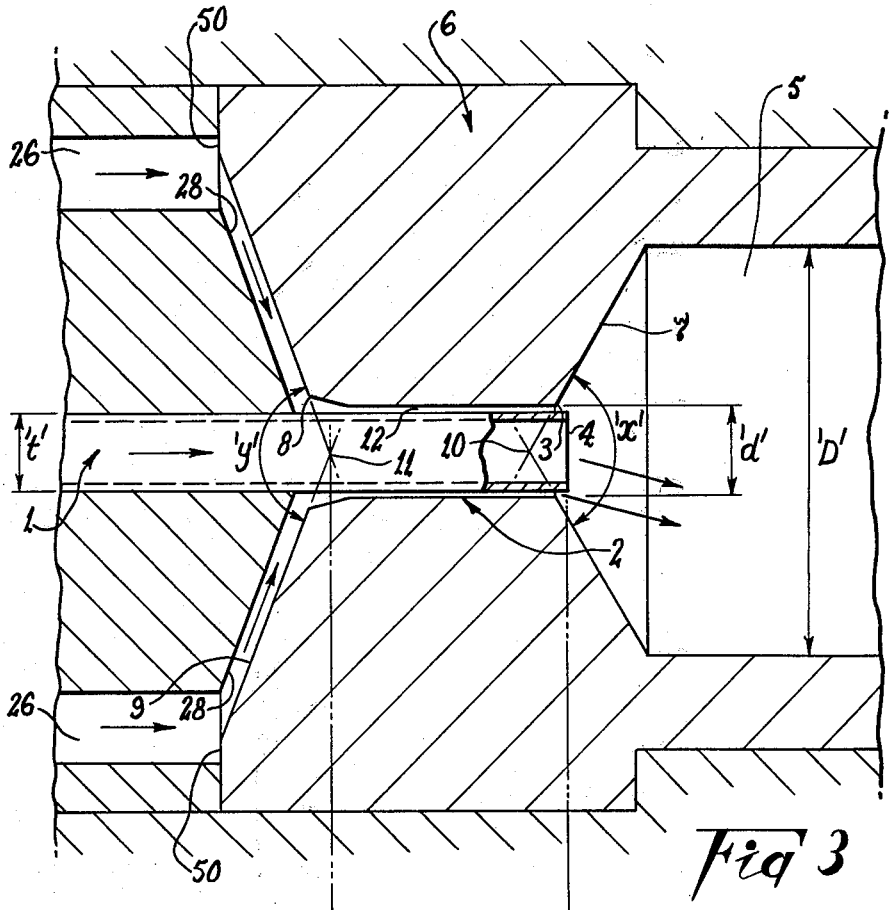
FIG. 3 is a view similar to FIG. 1 but showing one embodiment of the present invention.
Figure 4:
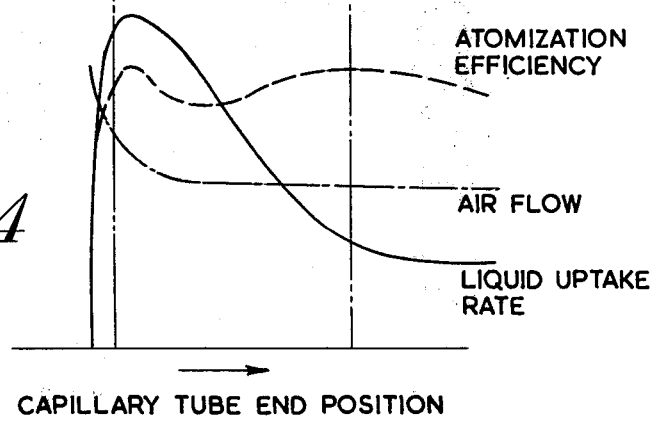
FIG. 4 is a view similar to FIG. 2 but related to the FIG. 3 construction.

It is significant that, in a nebulizer according to the invention, the capillary tube can extend through the venturi throat, with clearance, for a substantial part of the length of that throat and yet still obtain a high degree of atomization efficiency. As shown in FIG. 3, the tube 1 preferably extends through the complete length of the venturi throat 2, but does not project to a substantial extent beyond the outlet end 3 of that throat 2. Under normal circumstances, location of the capillary tube end 4 within the exit or outlet region of the venturi throat 2 would be expected to result in an unacceptably low level of atomization. In that regard, see the graph forming FIG. 2 which relates capillary tube position to atomization efficiency in the conventional prior construction of FIG. 1. The nebulizer of the present invention however, utilizes that previously unacceptable tube position in a manner such as to achieve good nebulizer performance and surprisingly reduces tube position sensitivity in that high atomization efficiency is achieved over a relatively large range of tube positions as is shown by FIG. 4. In the prior nebulizer of FIG. 1 however, the tube end position is very critical and high efficiency is achieved over a very small range of positions.

Figure 1:
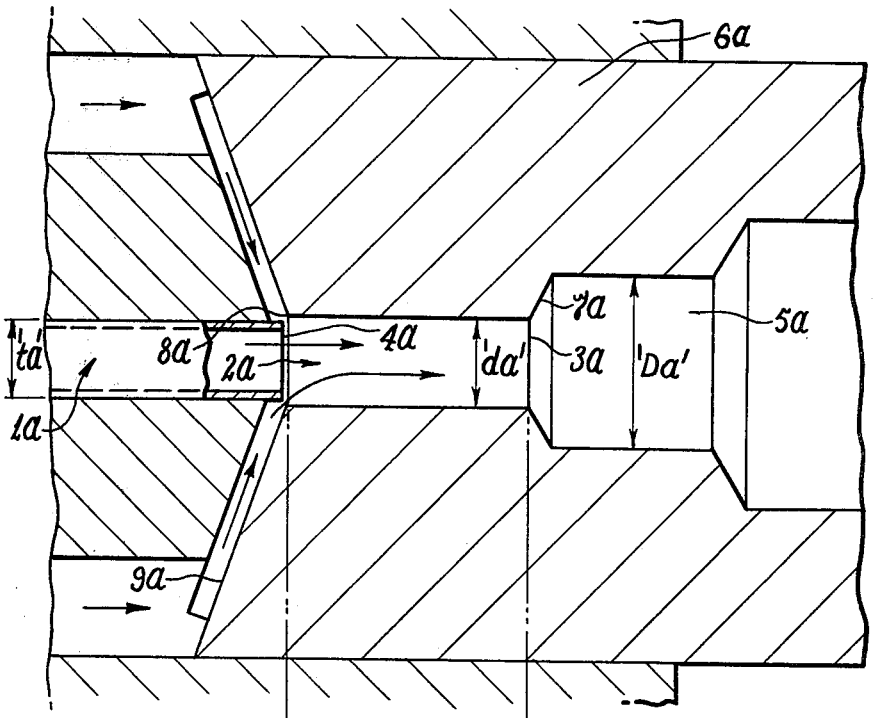
Fig 1 PRIOR ART
FIG. 1 is a diagrammatic view of a nebulizer of a kind known prior to the invention.

In FIG. 1, components corresponding to components of the FIG. 3 construction are given like reference numerals but with the suffix "a". A detailed description of the FIG. 1 construction is therefore not considered necessary.

A further feature of the FIG. 3 construction is that relatively high atomization efficiency is achieved with the tube end 4 positioned as in the prior construction of FIG. 1, or in any other position adjacent the throat inlet end. That will be apparent from a consideration of the FIG. 4 graph. It is thought that such a result arises from the fact that the venturi throat 2 emerges into a relatively large venturi chamber 5. Assuming the throat 2 and chamber 5 to be cylindrical, it is preferred that the diameter "D" of the chamber 5 is at least four times greater than the diameter 37 d" of the throat 2, but satisfactory results are achieved if "D" is more than twice "d".

As previously stated, the capillary tube 1 preferably extends the full length of the venturi throat 2, and in the form shown in FIG. 3 it projects a short distance beyond the outlet end 3 of the throat 2. Also as stated, the venturi throat 2 exits into a relatively large diameter chamber 5 of the venturi body 6 which allows for the necessary expansion of the liquid-gas mixture, and the end surface 7 of the chamber 5 adjacent the throat 2 is preferably frusto-conical so as to slope radially inwardly towards the venturi throat 2. In the preferred construction shown, the frusto-conical end surface 7 has an included angle "x" of 120° plus or minus 10°. The inlet end 8 of the throat 2 also preferably emerges through an indented frusto-conical surface 9, which in the construction shown is an end surface of the venturi body 6, and the included angle "y" of the surface 9 may be 140° plus or minus 10°.

The nominal length of the venturi throat 2 can be considered to be the distance between the imaginary apexes 10 and 11 (FIG. 3) of the two frusto-conical surfaces 7 and 9. The length of tube 2 projecting beyond imaginary apex 10 at the outlet end 3 of the venturi throat 2 may be three to twenty-four percent of the nominal length of the venturi throat 2, but something in the order of twelve to fifteen percent is preferred. In an example construction designed for use in spectroscopy, the nominal length of the venturi throat 2 is 2.25 mm plus or minus 0.025 mm and the projection of the capillary tube 1 beyond the imaginary apex 10 is 0.3 mm plus or minus 0.0225 mm. In that example, the actual length of the venturi throat 2 is approximately 2.675 mm., and the outlet end projection of the capillary tube 1 is roughly 0.05 mm. It is possible however, to achieve satisfactory results with the tube end 4 located between 0.175 mm. back from the throat outlet end 3 and 0.275 mm. beyond the throat outlet end 3.

In use, liquid is fed to the venturi chamber 5 through the capillary tube 1, and air or other support gas is fed into the chamber 5 through the clearance space 12 provided between the outer surface of the capillary tube 1 and the surrounding surface of the venturi throat 2. A suitable relationship between the two diameters "t" and "d" is to have the tube outside diameter "t" 70–75% of the diameter "d" of the venturi throat 2. In the aforementioned example construction, the diameter "t" is approximately 0.7 millimeters and the diameter "d" is approximately 0.95 millimeters, but other dimensions may be selected.

Figure 5:
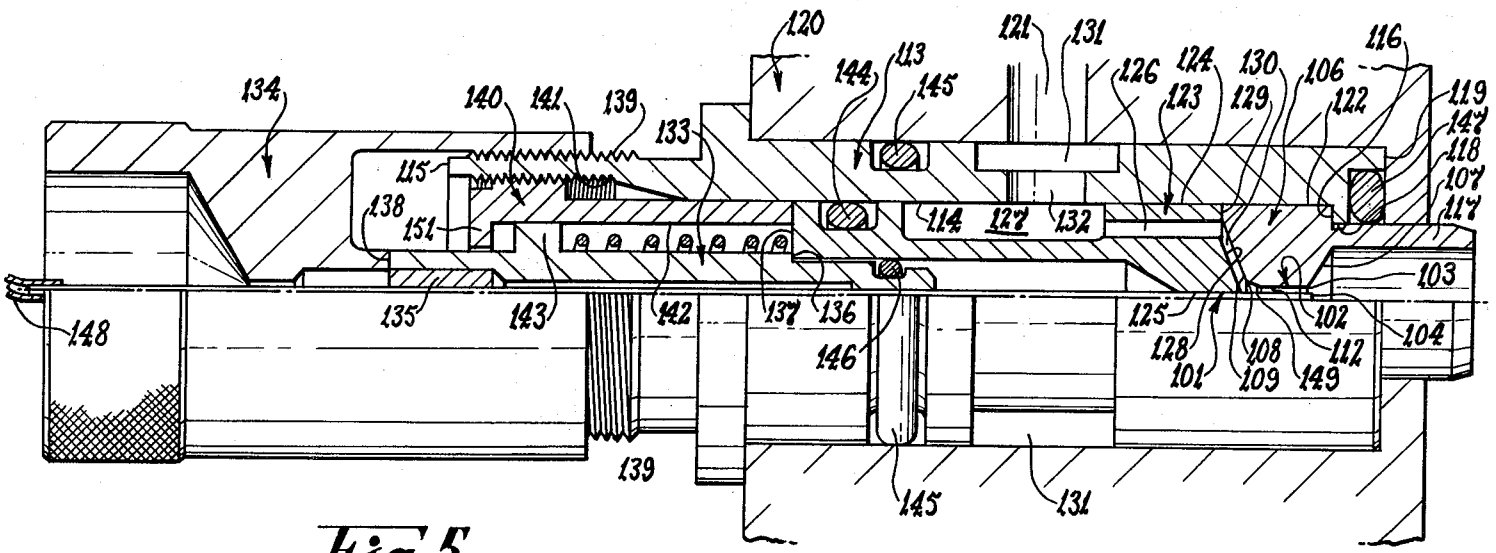
FIG. 5 is a partially sectioned view of an embodiment of the invention similar to that shown diagrammatically in FIG. 3.

It is desirable that the capillary tube 1 be located concentric with the venturi throat and that may be achieved in several ways. A preferred arrangement for achieving that and other characteristics of the nebulizer is shown in FIG. 5. The FIG. 5 construction is basically as described in connection with FIG. 3 and is a practical embodiment of the FIG. 3 arrangement. Components of the FIG. 5 construction corresponding to components of FIG. 3 will be given like reference numerals, but in the series 100 to 199.

In the preferred construction of FIG. 5 the nebulizer includes a main body member 113 having a guide bore 114 formed through an outer end 115. The major part of the bore 114 is of constant diameter in the construction shown, but may be stepped if desired, and terminates at an annular shoulder 116 which provides a limit stop for other components of the nebulizer as hereinafter described. A part 117 of the venturi body 106 projects through an axial hole 118 in the inner end 119 of the main body 113. The main body 113 serves as a centralizing guide for the operational components of the nebulizer as hereinafter described and in use may be mounted on a support structure 120 having a passage 121 connected to a source of air (not shown) or other gas.

The venturi body 106 has an external cylindrical surface 122 which fits neatly within the bore 114 and is concentric with the throat 102. The radial confinement of the venturi body 106 within the bore 114 retains the throat 102 concentric with the bore 114 which forms a datum for establishing concentricity of other operational components and particularly the tube 101. The axial position of the venturi body 106 within the bore 114 is fixed by abutment of that body 106 with the shoulder 116 as shown in FIG. 5.

A sleeve 123 is located within the bore 114 in end to end abutment with the venturi body 106 and has an external cylindrical surface 124 which also fits neatly within the bore 114 to provide radial confinement of the sleeve 123. The tube 101 extends axially through a bore 125 of the sleeve 123 which is concentric with the surface 124 and holds the tube 101 against radial movement. As shown in FIG. 5, the bore 125 is close to the venturi throat 102 and consequently the section of tube 101 within the throat 102 is held substantially coaxial with the throat 102. Such a concentric relationship between the throat 102 and the tube 101 contributes to achieving high atomization efficiency. It will be seen that the operational components 101, 106 and 123 can be removed from the main body 113 and replaced without disturbing the concentricity of the tube 101 and throat 102.

In the construction shown, the sleeve 123 also includes air passage means in the form of a plurality of passages 126 and a circumferential groove or manifold 127. The passages 126 extend axially of the sleeve 123 and are arranged regularly in a circle around the tube 101. In the construction shown, there are eight passages 126, but any other suitable number of passages may be adopted. As shown, the passages 126 communicate with the manifold 127 at one end and emerge through the inner end face of the sleeve 123 at their other end. That inner end face includes a radially inner part 128 and a radially outer part 129. The inner part 128 has a taper substantially complementary to that of the venturi body end surface 109, but of a smaller maximum diameter, and the outer part 129 abuts the adjacent end of the venturi body 106. As a result an air transfer space 130 is formed between the surfaces 128 and 109 and that space communicates with the inner end 108 of the throat 102. Air is introduced to the manifold 127 from passage 121 through a further manifold groove 131 and port 132 provided in the main body 113.

The axial position of the tube 101 relative to the throat 102 may be fixed in any appropriate fashion. In the FIG. 5 construction however, that position is fixed through a bush 133 secured to the tube 101 against relative movement and which is clamped between the sleeve 123 and a retainer nut 134. The bush 133 is secured to the tube 101 through a ferrule 135 fixed to both the bush 133 and the tube 101 by adhesive, soldering, welding, or any other suitable fixing means. Obviously, the bush 133 and the tube 101 can be secured together in a variety of ways different to that described. A shoulder 136 of the bush 133 abuts an end surface 132 of the sleeve 123 to locate the tube 101 at the desired axial position, and the nut 134 abuts an end surface 138 of the bush 133 to hold the tube 101 against the sleeve 123.

The nut 134 cooperates with an external thread 139 provided at the outer end portion of the main body 113 and it will be apparent that removal of the nut 134 from the main body 113 permits the tube 101 and connected bush 133 to be removed through the outer end 115 of the main body 113. That is subject to removal of a tubular nut 140 (hereinafter described) which forms another part of the retainer means. The tube 101 and bush 133 can be replaced within the main body 113 without requiring further calibration because the axial and radial positions of the tube 101 are automatically fixed by cooperation with the sleeve 123.

The tubular nut 140 is a security nut and serves to retain the venturi body 106 and the sleeve 123 in position within the bore 114. The nut 140 cooperates with an internal thread 141 of the main body 113 and abuts the outer end surface 137 of the sleeve 123. It is not possible to remove the nut 140 while the tube retainer nut 134 is in place, but when it is removed the venturi body 106 and sleeve 123 can be removed through the outer open end 115 of the main body 113. The nebulizer is thereby completely demountable and can be reassembled without further calibration because the operational position of each component is automatically fixed by cooperation and abutment as described. In a variation of the construction shown in FIG. 5, the internal end flange 151 of the tubular nut 140 may be omitted so that the tube 101 and bush 143 can be removed from the nebulizer while the tubular nut 140 remains in place.

In view of the length of the tube 101 it is preferred to support it concentric with the throat 102 at a location remote from the throat 102. In the construction shown that is achieved by cooperation between the tube bush 133 and a cylindrical bore surface 142 of the tubular nut 140. A flange 143 of the bush 133 has a outer cylindrical surface concentric with the tube 101 and which is an neat fit within the bore surface 142 so confining the bush 133, and consequently the tube 101, against radial movement.

Resilient O-rings 144, 145, 146 and 147 serve to seal the air or gas system of the nebulizer against the environment. Other types of seals can be used as considered appropriate. The main body 113 can be releasably secured to the support structure 120 by any suitable means and the outer end of the tube 101 is connectable to a liquid supply (not shown) through any suitable conduit 148.

It has been found that minimum disturbance of air flow from the passages 126 is achieved when the outer diameter of the surface part 128 is substantially coincident with the radially inner edge of each passage 126 as shown in FIG. 5. FIG. 3 also shows that relationship between the passages 26 and surface part 28, but on a larger scale. The air flow can be adversely affected if the outer diameter of the surface part 128 is substantially less than that shown in the drawings since an inward step is then formed between the passages 126 and the surface part 128. It is also preferred to provide a chamfer 149 at the throat entry end 108 to facilitate entry of air into the clearance space 112. The chamfer 149 also minimizes deterioration of the edge of the throat 102 due to erosion.

In a preferred construction of the kind described, the axial distance between the imaginary apex 11 (FIG. 3) and the surrounding annular end surface 50 (FIG. 3) of the venturi body 6, is 46–58% of the nominal length of the venturi throat 2. A length relationship of 50–52% however, has been found suitable. In the particular example construction previously mentioned, the distance in question is 1.15 millimeters plus or minus 0.075 millimeters.

Figure 6:
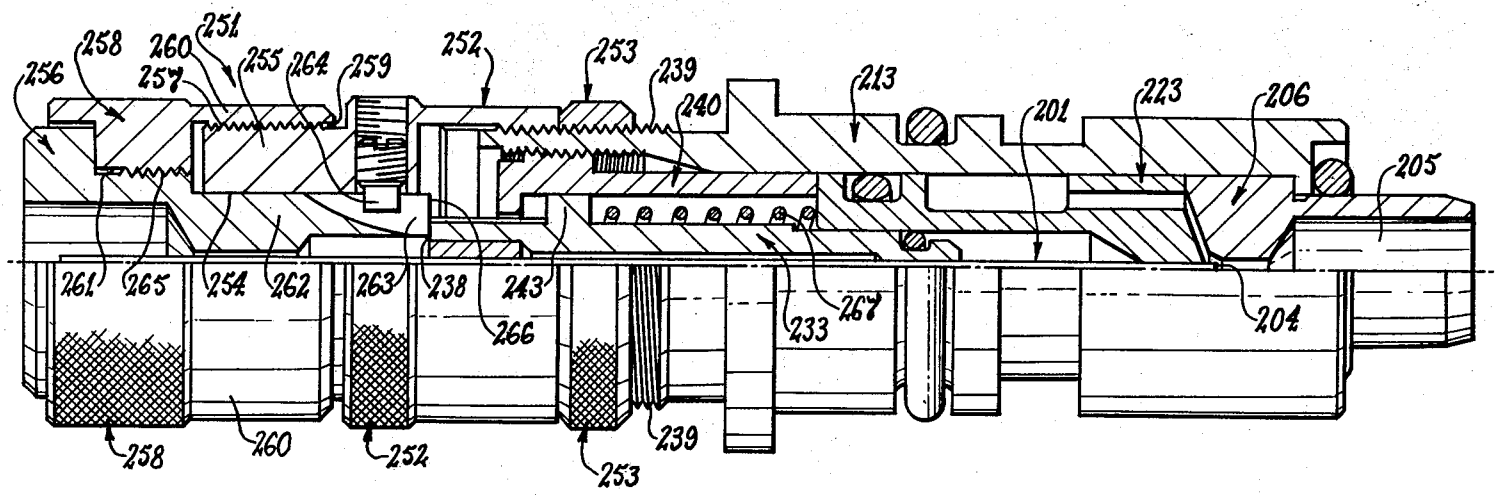
FIG. 6 is a view similar to FIG. 5, but showing an alternative embodiment of the invention.

The construction according to FIG. 6 is substantially the same as the FIG. 5 construction except that it provides for selective adjustment of the axial position of the liquid feed tube. Components of the FIG. 6 construction which correspond to components of the FIG. 5 construction will be given like reference numerals, but they will be in the series 200–299.

It will be apparent from a consideration of FIG. 6 that the main body 213, venturi body 206, tube assembly 201 and 233 and tubular nut 240 are substantially identical in form and arrangement to the corresponding components of the FIG. 5 construction. An adjustable assembly 251 however, takes the place of the retainer nut 134 of the FIG. 5 construction. The assembly 251 is operable to control the axial position of the tube 201 and is only one of several possible arrangements for achieving that control. Also, the assembly 251 may vary from the particular form shown and hereinafter described. Adjustment of the axial position of tube 201 may be desirable in order to adopt a particular rate of liquid uptake.

The adjustable assembly 251 includes a housing 252 which is attached to the main body 213 by cooperative engagement with the external thread 239 and is held in a selected position by a lock nut 253 engaging the same thread 239. The housing 252 is tubular and has a reduced diameter bore 254 provided within an outer end portion 255 for slidably receiving an inner adjusting screw 256 as hereinafter described. A thread 257 is formed on an outer surface of the housing portion 255 and a thimble 258 has an internal thread 259 within a barrel portion 260 thereof which cooperatively engages with the thread 257. A reduced diameter bore in the body of the thimble 258 also has an internal thread 261 and that is of smaller pitch than the thread 259 for a reason hereinafter made clear.

The inner screw 256 is also tubular to fit over the tube 201 and within the thimble 258 and housing 252. A cylindrical section 262 of the inner screw 256 slidably locates within the housing bore 254 and has an axially extending groove 263 in its outer surface which slidably receives a keying pin 264 secured to the housing 252. Cooperation between the pin 264 and groove 263 prevents rotation of the inner screw 256 relative to the housing 252 but permits relative axial movement. An external thread 265 of the inner screw 256 located outside of the housing 252 cooperatively engages with the thimble screw thread 261.

In operation, the thimble 258 is rotated to change the axial position of the tube end 204 relative to the chamber 205. As the thimble 258 rotates relative to both the housing 252 and inner screw 256 there will be an axial shift of the thimble 258 in the same direction relative to both the housing 252 and inner screw 256. The degree of relative shift however, will be greater for the housing 252 than for the inner screw 256 because of the difference in pitches between the threads 259 and 261. As a result, the thimble rotation will cause the inner screw to be shifted axially relative to the housing 252.

If the inner screw 256 is shifted to the right of FIG. 6, the abutment between its end face 266 and the bush end 238 will cause the bush 233 and connected tube 201 to be also moved to the right. The bush 233 and tube 201 will follow the reverse travel of the inner screw 256 because of the influence of the compression spring 267 acting between the sleeve 223 and the bush flange 243.

It will be appreciated from the foregoing description that the present invention provides a nebulizer of high efficiency and which is not subjected to the same sensitivity problems as prior nebulizers. As a further matter, the nebulizer of the invention is convenient to demount for maintenance purposes and can be re-assembled without requiring further calibration. Other advantages of the nebulizer will be apparent to those skilled in the art.

Finally, it is to be understood that various alterations, modifications and/or additions may be introduced into the constructions and arrangements of parts previously described without departing from the spirit or ambit of the invention as defined by the appended claims.

Having now described my invention what I claim as new and desire to secure by Letters Patent is:

1. A nebulizer including venturi means, a cylindrical throat and a cylindrical chamber each forming part of said venturi means and being arranged in substantially coaxial end to end communication, the diameter of said chamber being larger than the diameter of said throat, said throat having an inlet end remote from said chamber and an outlet end adjacent said chamber, said throat outlet end being at an end surface of said chamber, said end surface being frusto-conical and having an included angle within the range 110° to 130° inclusive, a liquid feed tube having an external diameter less than the diameter of said throat, said tube extending into said throat through said inlet and thereof and terminating at a location remote from said inlet end, and air feed passage means external of said tube and communicating with said throat inlet end.

2. A nebulizer including, venturi means, a cylindrical throat and a cylindrical chamber each forming part of said venturi means and being arranged in substantially coaxial end to end communication, the diameter of said chamber being larger than the diameter of said throat, said throat having an inlet end remote from said chamber and an outlet end adjacent said chamber, a liquid feed tube extending from a location remote from said throat inlet end towards said chamber and at least up to a location adjacent said throat inlet end, a main body member, a guide bore formed within said main body member, a venturi body having said cylindrical throat formed through one end and having a cylindrical outer surface which is concentric with said throat, said cylindrical outer surface is located within said main body member bore and has substantially the same diameter as said bore, a sleeve located within said main body member bore adjacent said one end of the venturi body, said sleeve having an external cylindrical surface and a bore concentric with that surface, said sleeve external cylindrical surface having a diameter substantially equal to the diameter of said main body member bore, said sleeve bore having substantially the same diameter as the external surface of said tube, said tube extending through said sleeve bore to be held thereby against lateral movement, at least one air passage formed in said sleeve and communicating with said throat inlet end, and retainer means holding said sleeve and said venturi body in fixed axial positions within said main body member bore.

3. A nebulizer according to claim 2, wherein said tube has an external diameter which is no more than 75% of the diameter of said throat and said tube extends into said throat through said inlet end thereof for a substantial part of the length of said throat.

4. A nebulizer with improved atomization efficiency characteristics including a main body member, a guide bore within said main body member, a stop shoulder within said bore and spaced from one end thereof, a venturi body at least partially located within said bore and abutting said stop shoulder, a throat formed through one end of said venturi body and having an inlet end at said one end, a chamber formed in said venturi body and communicating with the outlet end of said throat, a sleeve located within said main body member bore and abutting said one end of the venturi body, said sleeve having an end surface, a liquid feed tube extending coaxially through said sleeve and being held thereby against radial movement, said tube extending toward said chamber and at least up to a location adjacent said throat inlet end, at least one air passage formed in said sleeve and communication with said throat inlet end, retainer means releasably holding said venturi body and said sleeve in end-to-end abutment within said main body member, and a bush secured about said tube at a predetermined location between the ends of said tube, said bush abutting said end surface to fix the location of the terminal end of said tube relative to said throat inlet end.

5. A nebulizer according to claim 4, wherein said tube extends into said throat and terminates adjacent said outlet end thereof.

6. A nebulizer according to claim 4, wherein guide means is located within said main body member bore at a location remote from said venturi body, and said bush locates within said guide means to be held thereby against radial movement and thereby retain said tube in coaxial relationship with said throat.

7. A nebulizer according to claim 6 wherein said sleeve retains said tube coaxial with said throat at a location adjacent said throat.

* * * * *